US005660288A

United States Patent [19]

Nyman, Jr.

[11] Patent Number: 5,660,288

[45] Date of Patent: Aug. 26, 1997

[54] REVERSE HELIX TAMPER-EVIDENT CONTAINER

[75] Inventor: Henry H. Nyman, Jr., York, Pa.

[73] Assignee: Kerr Group, Inc., Lancaster, Pa.

[21] Appl. No.: 376,198

[22] Filed: Jan. 20, 1995

[51] Int. Cl.[6] ..... B65B 7/28

[52] U.S. Cl. ..... 215/44; 215/252

[58] Field of Search ..... 215/40, 44, 46, 215/252

[56] References Cited

U.S. PATENT DOCUMENTS

| | | | |
|---|---|---|---|
| 2,054,012 | 9/1936 | Teller | 215/252 |
| 2,162,713 | 6/1939 | Hamberger et al. | 215/252 |
| 3,001,657 | 9/1961 | Gamble | 215/252 |
| 3,484,012 | 12/1969 | White et al. . | |
| 4,458,821 | 7/1984 | Ostrowsky . | |
| 4,506,795 | 3/1985 | Herr . | |
| 4,530,438 | 7/1985 | McDevitt | 215/252 |
| 4,753,360 | 6/1988 | Baxter . | |
| 4,923,073 | 5/1990 | Wilde | 215/252 |
| 4,936,474 | 6/1990 | Szczesniak et al. . | |
| 5,137,163 | 8/1992 | Moore . | |

*Primary Examiner*—Stephen K. Cronin
*Attorney, Agent, or Firm*—Kenyon & Kenyon

[57] ABSTRACT

A container for use with tamper-evident closures, or tamper-evident child-resistant closures, having tamper-evident bands is provided. The container has threads for engaging corresponding threads on the tamper-evident closure. The container further has ramps for engaging tamper-evident elements on the tamper-evident band of the tamper-evident closure. The ramps hold the tamper-evident elements down while the closure is being rotated off of the container. Furthermore, the slant of the ramps actually serves to force the tamper-evident elements downward while the closure is rotated off. This greatly enhances the ease of removal of the tamper-evident closure, thus making the closure far easier to use, without sacrificing the important tamper-evident quality. Furthermore, the accelerated separation of the band from the closure enhances the tamper evidency features of the package by causing band separation upon distortion, before the closure/bottle seal is broken.

12 Claims, 1 Drawing Sheet

REVERSE HELIX TAMPER-EVIDENT CONTAINER

FIELD OF THE INVENTION

The present invention relates generally to combinations of closures and containers, and more specifically to a container which may be used to allow the faster and easier removal of tamper-evident closures from containers. In a container of the present invention, a variety of types of tamper-evident closures may be accommodated.

BACKGROUND OF THE INVENTION

It is well known to provide a closure and container combination with some variation of tamper-evident, or tamper-indicating assembly. The closures normally incorporate a cap portion connected to a band portion. Such a closure may be seen in the prior art FIG. 2, where the cap portion 1 is integrally connected to the tamper-evident band portion 2. Upon affixation of the closure onto a neck of a container, a set of n tabs, 3*a* to 3*n*, generally denoted as 3*k* and connected to the bottom of the band portion, which have elements directed inwardly and upwardly, engage an annular bead on the container neck. Upon the unthreading, and thus removal, of the cap portion, the band is separated from the cap and is retained on the container's neck. This is accomplished by the unthreading of the cap giving rise to an overall upward movement of the cap. Because of the action of the tabs against the annular bead, the tamper-evident band is prevented from moving upward. As a result, the band is separated from the cap as the latter moves upward with the unthreading motion. After the band is fully separated from the cap, it remains with the container neck and provides the user with evidence that the container and its contents may have been tampered with.

It is known that there are various container designs employed to assist in the operation of band portions from cap portions upon removal of the cap from the container. These designs typically use various locking assemblies whereby the band portion engages notches, or the like below the threading on the neck container to break the connectors and thereby separate the band portion when the cap is attempted to be removed.

The current tamper-evident closure designs sufficiently accomplish their intended purpose, that is, to provide the user with evidence of container tampering. Yet, for the average customers, the tamper-evident closure has become more of an obstacle than a useful benefit. In some cases the tamper-evident closure assembly is difficult, if not impossible, to remove by twisting the cap portion with the human hand. Unable to break the connectors and remove the cap by hand, users sometime incorporate sharp tools or kitchen utensils to break the band from the cap.

The problems associated with presently available tamper-evident closures is particularly acute when the user is a child, elderly person, or is simply physically unable to unthread the closure assembly. Cap designs such as that shown in U.S. Pat. No. 5,137,163 to Moore and U.S. Pat. No. 4,458,821 to Ostrowsky possess the ability to facilitate removal of the cap portion from the neck portion by using an angled annular bead to break the tabs of the cap band portion. However, such closures with angled annular bands may tend to apply undesirable stresses to the closure during the unthreading process. In particular, when the tamper-evident band is almost completely stripped off, the cap is at the furthest vertical distance from the annular bead. The significant distortion of the tamper-evident band may cause a corresponding distortion of the cap, and the band may actually not separate from the closure. If the closure is child-resistant, and thus requires additional manipulation, the difficulty in opening may be significantly increased.

Another problem associated with tamper-evident closure designs that utilize an annular bottle bead to engage tabs on a TE cap is the ability of some caps to be partially removed, breaking the cap/bottle seal, but not unthreaded enough to cause noticeable TE band distortion/separation.

There is a need for a tamper-evident container in which the benefits of a ramped annular bead, namely ease of closure removal, are obtained without the corresponding distortion. There is further a need for a tamper-evident container/closure system that accelerates closure/band separation and for containers in which a number of current tamper-evident closures may be accommodated.

SUMMARY OF THE INVENTION

Accordingly, it is a principle object of the invention to provide a container to be used with a tamper-evident closure with a tamper-evident band that allows for band separation to be initiated with the very slightest attempt to remove the closure from the container neck.

Another object of the present invention is to provide a container to be used with a tamper-evident closure with a tamper-evident band which allows the band portion to be separated from the cap portion quickly and simply without the need of complex maneuvering or special tools.

Yet another object of the invention is to provide a container to be used with a tamper-evident closure with a tamper-evident band where the container includes a ramp system that encircles the neck of the container for engaging threads on the tamper-evident band which create multiple contact points making the tamper-evident feature much harder to defeat.

A further object is to provide a tamper-evident system which may be used with child-resistant closures to ease the demands on the user in opening this type of closure.

In accordance with the present invention, the objectives, as well as to others not specifically identified, are achieved generally by the container described herein. The container assembly generally comprises a typical container, a neck extending upward from the container, a thread helically encircling the neck of the container engaging a corresponding thread on a closure, an annular tamper-evident retention bead for engaging a tangible tamper-evident band, and at least one lead ramp located adjacent to but beneath the annular tamper-evident retention bead for separating the frangible tamper-evident band from the closure when the closure is rotated off the neck portion.

In a preferred embodiment of the invention the container threads are right handed and the lead ramp encircles the neck portion in a left handed manner. Preferably at least two lead ramps encircle the neck portion.

DETAILED DESCRIPTION

Figure 2:
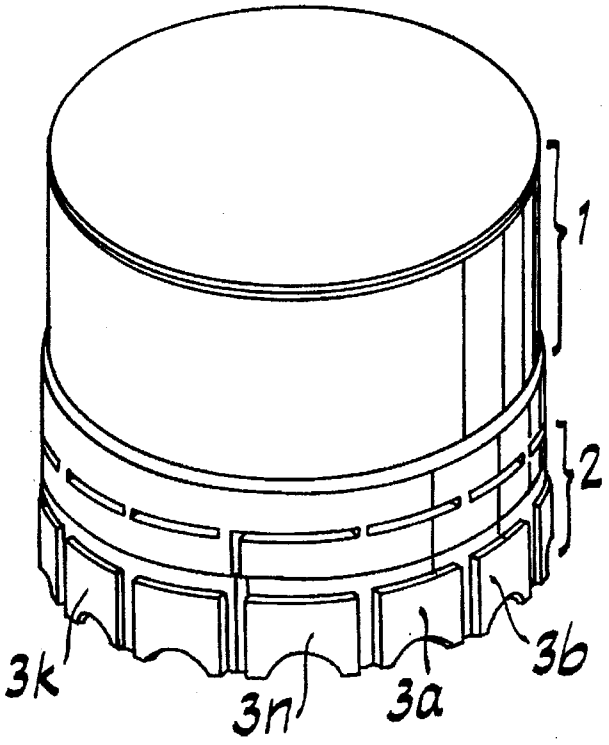
FIG. 2 PRIOR ART
FIG. 2 illustrates a prior art tamper-evident closure which may be advantageously used with a container of the present invention.
Figure 1:
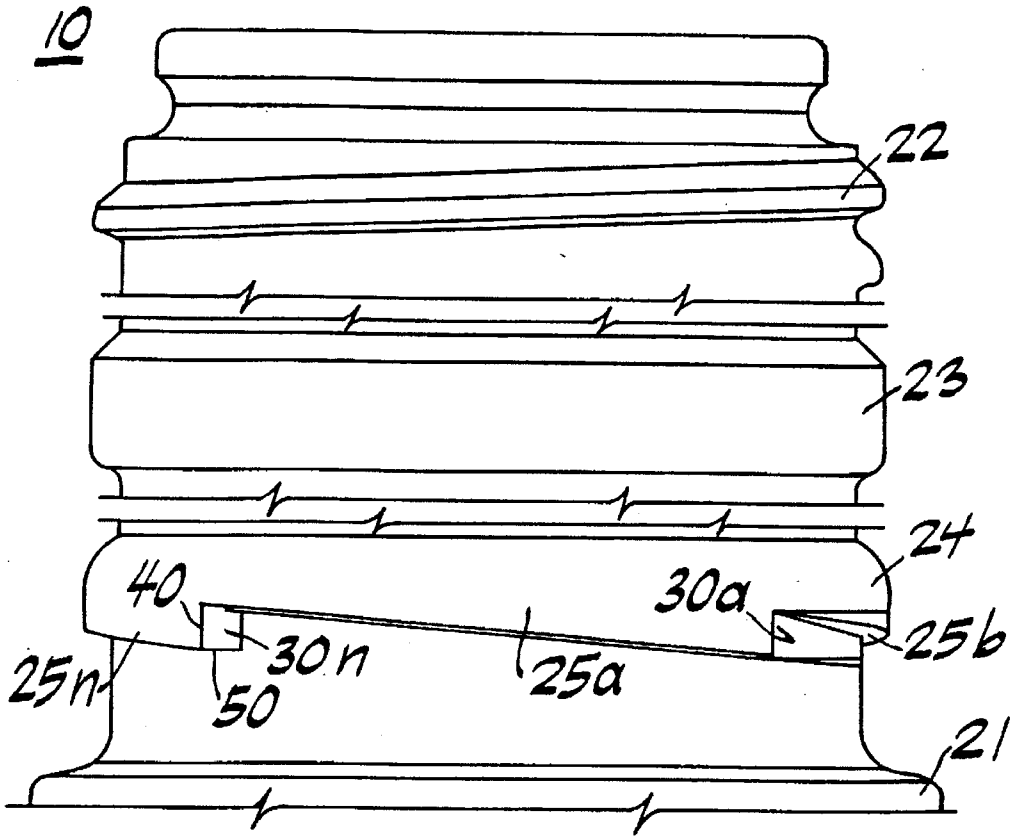
FIG. 1 illustrates a partial side view of a container of the present invention which is broken away to indicate indeterminate neck height.

FIG. 1 shows an embodiment of a container neck 10 of the present invention. The neck 10 extends generally from the shoulder 21 of a container. The container may be a typical blow-molded plastic container, and will work equally well with most any tamper-evident closure having a frangible tamper-evident band. The neck 10 has threads 22 molded externally thereon. These threads 22 engage corresponding threads on a tamper-evident closure. The capping process may or may not include the use of these threads to put the cap on the neck 10. The helical nature of the threads provides that, when the cap is rotated off of the neck 10, the cap moves in a direction parallel to the axis of the container and away from the bottom of the container.

The neck 10 also has molded thereon a ramped tamper-evident retention bead 24 which is generally positioned below threads 22. The cylindrical section 23, which is shown in the figure as broken away to indicate indeterminate axial length, is provided to be indeterminate in length to accommodate a wide variety of types of existing and future tamper-evident closures. That is, closures with a range of distances between their threads and their annular retention beads may be accommodated by an appropriately sized neck.

The tamper-evident retention bead 24, which is shown in the figure as ramped, has a special shape along the bottom edge thereof to accomplish, in part, the objects of the present invention. In particular, at least one ramp is provided which circles the periphery of the container neck. Preferably a plurality of ramps are provided. These ramps are illustrated in FIG. 1 as ramps 25. The full ramp shown in the figure is denoted ramp 25*a*, and the rest are indicated by elements 25*b* through 25*n*. The ramps are generally triangular wedges. The length of the ramp, along the circumference of the neck, may be equal to the circumference of the annular tamper-evident retention bead 24 divided by the number of ramps. The height of each ramp, which may be indicated by the height of elements 30, is generally a small fraction of the length. This height is indicated in the figure by numeral 40. A typical height may be, for example, in range of 5–10 percent of the length.

The thickness of the ramp 25, i.e., the distance the ramp extends in a radial direction from the neck, is preferably the same as the distance the annular tamper-evident retention bead 24 extends from the neck. This distance is shown in the figure as approximately 10 percent of the radius of the neck, and is indicated in the figure by numeral 50.

In the typical use of a container of the present invention, a tamper-evident closure is generally desired to be removed from the container to allow access to the contents of the container. The container of the present invention allows this to be accomplished in an especially easy and convenient manner.

As described above, prior art closures had their tamper-evident bands removed from their cap portions by the action of the tabs 3 pushing against an annular retention bead. It should be noted that while herein the tamper-evident elements attached to the band are referred to as tabs, the container of the present invention may accomodate a wide variety of types of tamper-evident elements—they need not be tabs. Basically, any tamper-evident element which engages an annular retention bead may take advantage of a container of the present invention. One aspect of the present invention that is particular advantageous is that the ramps 25 do not merely prevent the tamper-evident tabs from moving upward with the unthreading of the container, but they also actively force the tabs downward. This is done as a result of the reverse-helix nature of the helicity of the ramps. The ramps 25 have a helicity opposite to that of the threads 22. In this way, as the closure threads engage threads 22, the cap is moved upward in normal fashion. Simultaneously, the ramps 25 engage the tamper-evident elements on the closure, and force the elements downward as the closure is rotated.

In this way, the tamper-evident band is separated from the rest of the cap much faster than in the prior art systems. Moreover, less rotation is required to fully remove the cap from the container. Therefore, less stress is placed on the bottom edge of the cap. This is particularly important when the cap is rotated to a position a large axial distance from its starting point, but before the band is fully removed. At this point, large stresses may be placed on the cap, thus distorting it. The present invention, in part, minimizes these stresses and eases the removal of the closure.

It is also important to note that this type of tamper-evident system, while useful in any tamper-evident system having a frangible band, may also be advantageously used with child-resistant closures. In fact, the added manipulation required in a child-resistant closure makes the easy removal of the tamper-evident band that much more beneficial, especially to users with impaired motor skills. For example, a child-resistant closure such as that disclosed in U.S. Pat. No. 4,506,795, assigned to Kerr, may be advantageously used with the present invention.

Those skilled in the art will understand that the various optional features of the disclosed container may be combined in any number of ways without departing from the scope of the present invention. In addition, while the invention has been described in regard to a container which may accomodate closures with tabs, those skilled in the art will recognize that a closure according to the present invention may be any shape and that the scope of the invention is to be limited only by the claims appended hereto and equivalents thereof.

What is claimed is:

1. A container for use with a closure with a frangible tamper-evident band, comprising:

a neck extending upward from a receptacle;

at least one thread helically encircling said neck for engaging at least one corresponding thread on the closure;

a tamper-evident retention bead for engaging a plurality of tabs on the frangible tamper-evident retention bead; and at least one lead ramp comprising triangular wedges located below said tamper-evident retention bead for separating the frangible tamper-evident band from the closure when the closure is rotated off of the neck, said at least one lead ramp having a helicity opposite that of said thread.

2. The container of claim 1, wherein said thread is right-handed.

3. The container of claim 1, wherein said at least one lead ramp helically encircles said neck in a left-handed orientation.

4. The container of claim 1, wherein the number of said lead ramps is at least two.

5. The container of claim 1, wherein said tamper-evident retention bead is located below said at least one thread.

6. The container of claim 1, wherein said container is made of plastic.

7. The container of claim 1, wherein said container is made of glass.

8. The container of claim 1, wherein said tamper-evident retention bead is ramped.

9. A closure and container system, comprising:

a closure comprising a cap portion and a frangible tamper-evident band portion, the band portion having a plurality of tabs directed inwardly of the band and connected therewith for engaging a bead on a container neck; and a container including:

a neck extending from a receptacle;

a thread helically encircling said neck for engaging a correspondence thread on said closure;

a tamper-evident retention bead constructed for engaging the tabs on the frangible tamper-evident band; and at least one lead ramp located below said bead and engaging at least one of the closure tabs for separating the frangible tamper-evident band from the closure when said closure is rotated off of said neck, said at least one lead ramp having a helicity opposite that of said thread.

10. The system of claim 9, wherein said thread is right-handed.

11. The system of claim 9, wherein said tamper-evident retention bead is ramped.

12. The system of claim 9, wherein the ramp comprises a triangular shaped wedge.

* * * * *